United States Patent [19]

Bondoc et al.

[11] Patent Number: 4,835,929

[45] Date of Patent: Jun. 6, 1989

[54] LAMINATED ROOFING HIP

[75] Inventors: Alfredo A. Bondoc, So. Bound Brook; William R. Carroll, Sussex; Bobbie J. Lloyd, Kinnelon, all of N.J.

[73] Assignee: GAF Corporation, Wayne, N.J.

[21] Appl. No.: 148,249

[22] Filed: Jan. 25, 1988

[51] Int. Cl.[4] ..... E04D 1/00

[52] U.S. Cl. ..... 52/518; 52/276; 52/553

[58] Field of Search ..... 52/518, 553, 276, 278, 52/53, 47, 535

[56] References Cited

U.S. PATENT DOCUMENTS

| | | | |
|---|---|---|---|
| 1,295,361 | 2/1919 | Overburg | 52/276 |
| 1,862,627 | 6/1932 | MacLean | 52/276 |
| 2,062,149 | 11/1936 | Stark et al. | 52/553 X |
| 2,161,440 | 6/1939 | Venrick | 52/553 X |
| 2,393,379 | 1/1946 | Jones | 52/276 |
| 3,913,294 | 10/1975 | Freiborg | 52/518 |
| 3,937,640 | 2/1976 | Tajima et al. | 52/518 X |
| 4,404,783 | 9/1983 | Freiborg | 52/518 |
| 4,464,872 | 8/1984 | Eaton | 52/518 X |

*Primary Examiner*—Carl D. Friedman

*Attorney, Agent, or Firm*—Marilyn J. Maue; Joshua J. Ward

[57] ABSTRACT

A laminated composite roofing hip comprising a flexible, foldable panel having a central fold line along its horizontal length, a leading vertical edge and a rear vertical edge, a riser strip positioned over said panel having a leading vertical edge, a rear vertical edge conterminous with the rear vertical edge of said panel, a central fold line mateable with said panel central fold line, a longitudinal dimension between about 117th and about 2/3rds the length of said panel and a height approximately equal to that of said panel, said riser strip being laminated top said panel in a restricted 0.5 to 3 inch vertical area along the length of the riser strip so as to allow free vertical displacement of the non-laminated riser strip portions over the surface of the underlying panel. The invention also relates to the process of installing said composite roofing hip at an edge, a ridge, or a valley of a pitched roof and to a roof finished with the laminated roofing hips of the present invention.

18 Claims, 4 Drawing Sheets

LAMINATED ROOFING HIP

THE INVENTION

For the purpose of this invention, the term "hip" is intended to include a shingle member adaptable to any angle formed by the meeting of two sloping sides of a roof which includes the angle formed between the plane of a roof, and roof edge facia, and the angles formed by a roof ridge or a roof valley. Thus, the present laminated roofing hips can be applied at any intersection of roofing planes.

In accordance with the present invention there is provided a composite roofing hip composed of a flexible, foldable, generally flat panel member having a length of from about 8 to about 24 inches and a height of from approximately 10 inches to about 24 inches; and having a central fold line along its entire horizontal length, and having a leading vertical edge and a rear vertical edge as a first component of the composite and, as a second component, a flexible, foldable riser strip member of approximately the same height as said panel and having a horizontal dimension of from about 1/7th to about 2/3rds the length of said panel member, a rear vertical edge conterminous with the rear vertical edge of said panel and having a central fold line mateable with the central fold line of said panel, said strip being laminated across its entire length in a restricted width area of between about 0.5 and about 3 inches to said panel in a manner so as to allow free vertical movement of the non-laminated portions of said riser strip over the surface of the underlining panel.

Although the length of the riser strip may represent between about 1/7 to 2/3rd of the length of said panel its preferred length is between about 1/5th and 1/3rd that of the panel. Accordingly, each hip unit has an exposure of from about 6/7ths to about 1/3rd and preferably between about 4/5 to about ⅓ its length.

Another preferred arrangement of the present composite hip is described by a riser strip being centrally laminated across its entire length to the underlying panel in an area from about 0.5 to about 3 inches bridging both sides of a vertically centered fold line of said riser strip which is mated to the central fold line of said panel. A further preference of the present composite roofing hip includes a panel unit of at least two plies and a riser strip of at least one ply construction, said plies composed of any conventional roofing shingle material. However, it is to be understood that either or both of the panel and the riser strip of the present composite can include 1 to 5 plies, depending upon preference of the user and the aesthetic effect.

Installation of the present composite roofing hips entails positioning the hip unit so that the riser strips face leeward, nailing each unit to the roof deck through the combined plies of the riser and panel sections and overlapping the entire length of each riser strip with the riser free leading panel portion of the next composite hip unit and repeating the above steps along the entire roof section to be covered.

Installation of the present roofing hips along a roof edge, roof ridge and/or roof valley in this manner provides many physical and aesthetic advantages. One important advantage realized by installation of the present composite roofing hips along the ridge and edge sections of a roof is the introduction of numerous venting sites which are formed between each pair of roof hip units and which are delineated by the venting space formed by the opening to the roof deck at the overlapped areas as is more clearly defined by numeral 30 in FIG. 2A of the drawings. It will become apparent that by varying the number of plies employed for the panel and riser strip portions, the venting areas can be increased or decreased to suit the demands of the user and geographical location of the roofing site. Also, the aesthetic appearance of the finished roof is enhanced and similates natural roofing material by the shadow effect resulting from the riser strip overlayed with the leading edge of the next panel portion in a series of mounted units. Normally, asphalt shingle roof construction employs a single continuous strip along the ridge and valleys of a roof. The roof edges are usually devoid of any finishing member and the courses of shingle material are merely cut off at a roofing facia board leaving a rough unfinished appearance. Also, such prior roofing installations do not provide for venting since the materials used for valleys and ridges are continuous non-composite strips. Venting for such roofs requires a separate member such as that described in U.S. Pat. No. 4,676,147 to accomplish this end which materially adds to the expense of roofing. The inherent venting accomplished by the present invention which occurs at each interval of joined hip units along roof ridges and edges provides numerous exhaust sites in areas where the air temperature is highest, namely, at the peak and upper edge sections of a roof.

For a more detailed description of preferred embodiments of this invention, reference is now had to the accompanying drawings of which:

DETAILED DESCRIPTION OF THE DRAWINGS

Figure 1:
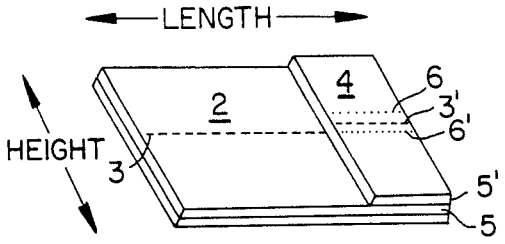
FIG. 1 is a plan view of a single laminated hip unit.

FIG. 1 illustrates a single composite hip unit wherein panel 2, composed of two plies, is laminated to single ply riser strip 4 in a restricted lamination area indicated between dotted lines between 6 and 6'. The rear vertical edges 5 and 5' of the panel and riser strip members are conterminously positioned. The center fold line of panel 2 and riser strip 4 is designated by 3 and 3' respectively and represents the fold line where the hip unit is bent to conform with the angle of a roof ridge, a roof edge or a roof valley. It is to be understood however that the plies of components 2 and 4 may be widely varied for shadow effect and for wider venting areas as will become apparent to one skilled in the art from the subsequent disclosure and particularly FIG. 2A. However, for purposes of illustration FIGS. 1 through 5, are described as having a two play panel laminated to a one ply riser strip.

Figure 2:
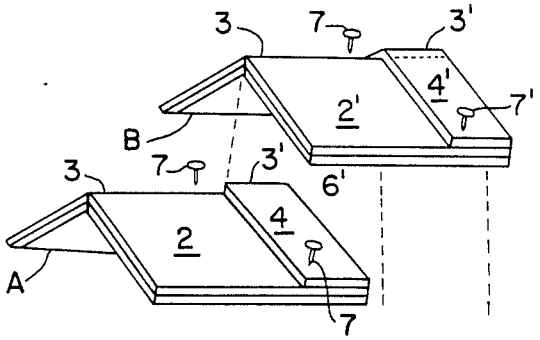
FIG. 2 is a perspective view in elevation of positioning a series of composite hip units for installation on a roof ridge.

FIG. 2 represents an elevated perspective view showing positioning at installation of a series of individual hip units when employed on a roof ridge. In FIG. 2 a plurality of the hip units shown in FIG. 1 are bent along their center fold line to conform with the angle of the roof ridge. Unit A is then nailed in place to the roof deck by means of nails 7 and 7' at approximately corresponding lower depending end portions of riser strip 4 before the next hip unit, B, is bent and positioned over the first hip unit so that panel portion 2' completely covers riser strip portion 4. Each of the hip units are attached to the roof deck by nailing through the combined plies of panel and riser strip sections in a similar manner. Successive positioning, bending and securing of individual hip units to the roof deck are repeated along the entire roof ridge to present an aesthetic finished appearance. FIG. 2B illustrates a roof ridge whereon the present laminated hips have been installed. The plane of the roof is indicated by 31 and venting areas occurring between the rear vertical edge of units A and B, where the leading edges of units B anc C overlap said preceding units and are sloped to the roof deck for nailing are indicated by triangular areas 30. From FIG. 2A, it will be appreciated that the dimensions of the venting areas are directly proportional to the thickness of the panels and/or the riser strips and the length of the hip units. Thus, hip units can be selected for moderate venting in cooler geographical zones and maximum venting in tropical zones.

Figure 2A:
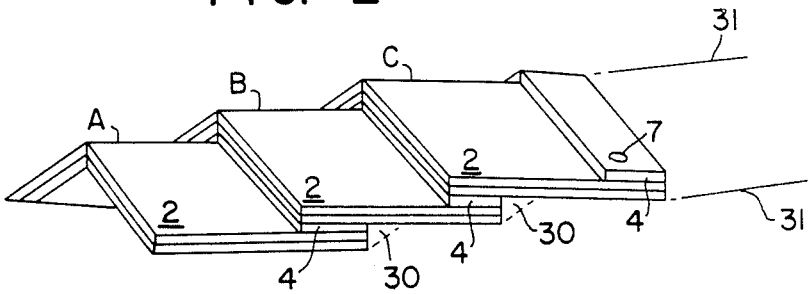
FIG. 2A is a perspective view of the present units installed along a roof ridge.

For the purposes of the present invention, the length of panel section 2 can vary between about 8 and about 24 inches and the height of each hip unit can vary between about 10 and about 24 inches. Accordingly, the number of venting sites can be varied by the length of the panel units. In FIG. 2A there is shown about an 8 inch exposure of panel 2 and an additional 3 inches of panel laminated to riser strip 4 so that the overall panel length is about 11 inches. In this particular embodiment, the overall height of both the panel and riser strip is about 12 inches. These proportions represent only one of many preferred embodiments for the composite hip unit of the present invention.

Figure 3:
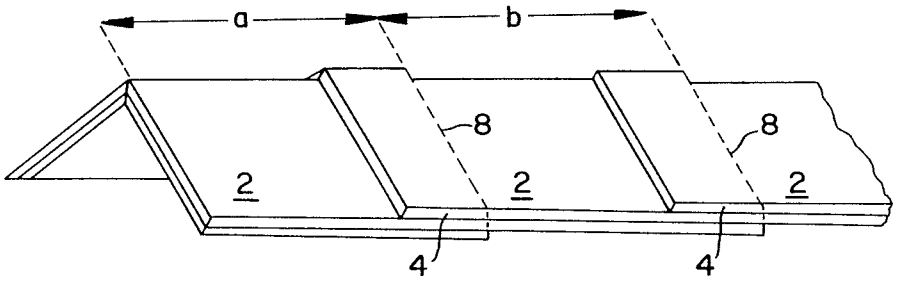
FIG. 3 is a perspective view of a manufactured sheet of individual composite hip units which units are easily separated at the time of use.
Figure 3A:
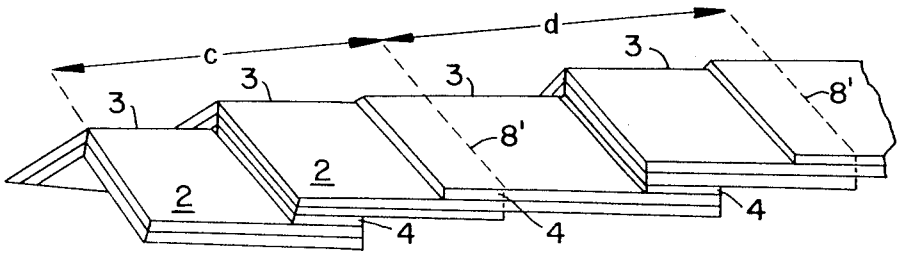
FIG. 3A is a perspective view of a manufactured sheet of integrally paired composite hip units, said paired units being easily separatable at the time of use.

It will become apparent from this disclosure that the hip units can be manufactured and supplied in a continuous sheet exemplified by FIG. 3 where the units, a and b, can be easily separated at perforations 8 by the roofer at the time of installation. It is also conceivable that a plurality of integrally joined hip units, c and d, separable at perforations 8'; as shown in FIG. 3A can be made available for affixing a plurality of hip units in a single nailing operation. However, it is preferred, particularly for roofs having a pitch angle less than 90°, that each hip unit be separately affixed to the roof deck to insure against wind-lift and slippage.

Figure 4:
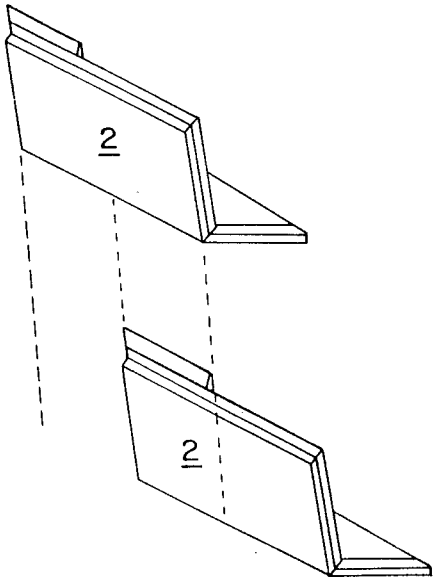
FIG. 4 is a perspective view in elevation of a series of laminated hip units installed at a roof valley.

FIG. 4 is an elevated perspective view of positioning and mounting individual hip units which have been bent to conform with the valley of a roof deck. As in the foregoing illustrations, the hip unit is attached to the deck by nailing on both sides of the valley through the riser strip in an area removed from the center fold line before overlaying and mounting the next hip unit.

Figure 5:
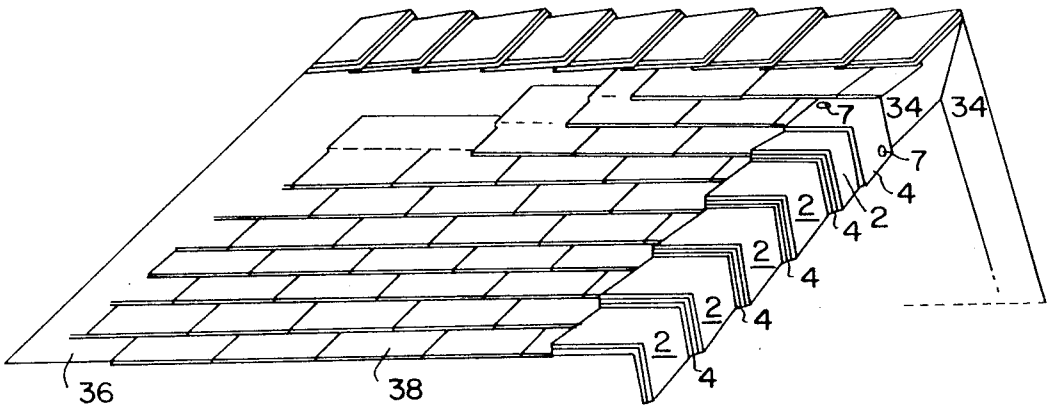
FIG. 5 is a perspective view of composite hip units installed along a roof edge and FIG. 6 is a diagrammatic view of circulation and venting of hit air which accumulates in the roof area and which is evacuated by means of the present laminated hips when employed at the ridge and edge sections of a roof.

FIG. 5 illustrates installation of a series of the present hip units along the edge of the roof to provide a finished uniform appearance which is pleasing to the eye. In FIG. 5, roof deck 36 is covered with shingles 38 and facia board 34 is attached along the roof rake. The hip units are nailed on one side to the roof deck and on the other side to the facia board at both sides of the riser strip as indicated by numeral 7.

Figure 6:
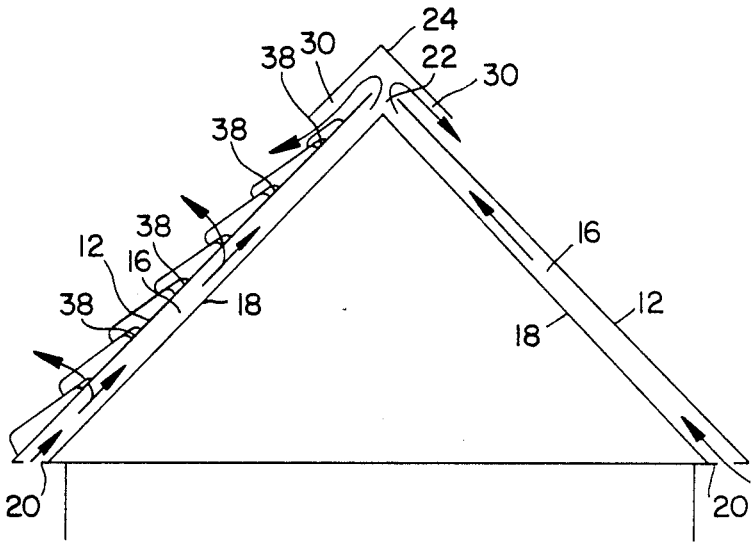

FIG. 6 is a diagrammatic view of air flow, indicated by arrows, from apertures 20 in the roof eaves to the roof ridge having open trough 22 in the deck extending along the length of the peak. As shown by numeral 30 of FIG. 2A, installation of the present laminated hips 24 over the roof ridge provides egress of hot air at numerous sites along the ridge. Also, installation of the laminated hips along roof rake 16 provides for additional air circulation and continuous venting at numerous sites 38, intermediate the eaves and roof ridge.

Many modifications and alterations in the above described arrangement of hip units and their installation at valleys, ridges and edges of a roof will become apparent to those skilled in the art without departing from the scope of this invention. For example, the area of laminating the riser strip to the panel need not be centrally located at the fold line but may be positioned at either side of the central fold. Also the fold line need not be positioned at the exact center of the panel and riser strip but can be offset to meet the needs of a particular roofing constructin. Thus, where a narrow facia board is employed, a major portion of the hip unit may rest upon the shingles overlaying the roof deck with only a minor portion depending over the side to cover the facia board. These and other modifications will become apparent from the foregoing description and disclosure.

Having thus described the invention, what is claimed is:

1. A laminated composite roofing hip unit comprising
(a) a foldable generally flat panel member having a horizontal fold line along its entire length, a leading edge disposed perpendicular to the length of said panel and a rear edge disposed perpendicular to the length of said panel and
(b) a separate foldable riser strip member of approximately the same height as said panel and a length of from about 1/7 to about ⅔ of said panel, and having a continuous leading edge disposed perpendicular to the length of said riser strip and a continuous rear edge disposed perpendicular to the length of said riser strip, a horizontal fold line mateable with the fold line of said panel said riser strip being laminated in a fractional portion of its height to said panel in a restricted 0.5 to 3 inch area so as to provide non-laminated and laminated portions of said riser strip, said riser strip being mounted on said panel member in a manner such that the rear edge of said riser strip is conterminous with the rear edge of said panel and in a manner so as to allow free planar movement of the non-laminated portions of said riser strip over the surface of said panel when subjected to deformation.

2. The laminated composite hip unit of claim 1 wherein said panel member has a length of between about 8 and about 24 inches and a height of between about 10 and about 24 inches.

3. The laminated composite hip unit of claim 2 wherein the central fold line of the panel member and riser strip member is centrally located.

4. The laminated composite hip unit of claim 3 wherein the central horizontal fold center line of the riser strip member is mated to the central horizontal fold center line of the panel member by lamination along the entire length of the riser strip in an area of 0.25 to 1.5 inches extension bridging both sides of the central horizontal fold center line.

5. The laminated composite hip unit of claim 1 wherein the length of the riser strip member is between about 1/5 and about ⅓ the length of said panel member.

6. The laminated composite hip unit of claim 1 wherein said panel member is composed of at least two plies of roofing material and said riser strip member is composed of at least one ply of roofing material.

7. A plurality of the laminated composite hip units of claim 1 contiguously disposed in a longitudinally extended sheet, said units being separable each from the other by perforations which mark the boundaries of each unit.

8. A roof having a roof deck and a roof portion having an intersecting plane at which a series of hip units of claim 1 are each nailed to the roof deck through said riser strip member along the entire length of said intersecting plane and wherein the leading edge of each successive hip unit completely overlays the riser member of the preceding hip unit.

9. The roofing portion of claim 8 wherein air venting areas are provided at the rear edge of each riser strip member overlaid by the leading edge of a successive hip member.

10. The air venting areas of claim 9 wherein dimension of said areas are directly proportional to the number of plies comprising the panel member and/or the riser strip member of the hip units.

11. The air venting areas of claim 9 wherein the number of said areas are directly proportional to the length of the panel members of the hip units.

12. The roof portion of claim 8 wherein said intersecting planes define a roof valley.

13. The roof portion of claim 8 wherein said intersecting planes define an edge of a roof abutted to a facia board.

14. The roof portion of claim 8 wherein the area of intersecting planes defines a ridge section of a roof.

15. The roof portion of claim 8 wherein the area of intersecting planes defines a valley section of a roof.

16. The roof portion of claim 8 wherein the area of intersecting planes defines a roof edge in abutment with a facia board.

17. A roof having a roof deck and a roof ridge whereon a series of hip units of claim 1 are each nailed to the roof deck through said riser strip member along the entire length of said roof ridge and the leading edge of each successive hip unit completely overlays the riser member of the preceding hip unit.

18. The process of installing the laminated composite hip units of claim 1 along intersecting planes of a roof which comprises:

(a) placing a first hip unit with the riser strip member exposed and facing in a leeward direction over the intersection and bending the hip unit along its fold line to conform with the angle of intersection;

(b) nailing said first hip unit through the riser strip member to the roof deck on both sides of the intersection;

(c) bending a second hip unit with its riser strip member exposed and facing in a leeward direction along its fold line to conform with the angle of intersection and completely overlapping the riser strip member of the first hip unit with the leading edge of the panel member of the second hip unit;

(d) nailing said second hip unit through the riser strip member to the roof deck on both sides of the intersection and (e) repeating steps (c) and (d) for mounting and securing of each of a successive number of hip units.

* * * * *